US010810964B2

(12) United States Patent
Park et al.

(10) Patent No.: US 10,810,964 B2
(45) Date of Patent: Oct. 20, 2020

(54) DISPLAY DEVICE ADJUSTING LUMINANCE OF PIXEL AT BOUNDARY AND DRIVING METHOD THEREOF

(71) Applicant: Samsung Display Co., Ltd., Yongin-si (KR)

(72) Inventors: Sung Jae Park, Wonju-si (KR); Jae-Gwan Jeon, Incheon (KR); Kyung Su Lee, Hwaseong-si (KR); Dong Won Park, Asan-si (KR); Dong Hwa Shin, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 74 days.

(21) Appl. No.: 15/805,906

(22) Filed: Nov. 7, 2017

(65) Prior Publication Data

US 2018/0130437 A1 May 10, 2018

(30) Foreign Application Priority Data

Nov. 10, 2016 (KR) ..... 10-2016-0149860

(51) Int. Cl.

| | |
|---|---|
| ***G09G 3/36*** | (2006.01) |
| ***G09G 3/20*** | (2006.01) |
| *G09G 3/3225* | (2016.01) |

(52) U.S. Cl.

CPC ..... *G09G 3/3685* (2013.01); *G09G 3/2092* (2013.01); *G09G 3/2003* (2013.01); *G09G 3/3225* (2013.01); *G09G 3/3607* (2013.01); *G09G 2300/0452* (2013.01); *G09G 2320/0233* (2013.01); *G09G 2320/0285* (2013.01); *G09G 2360/16* (2013.01)

(58) Field of Classification Search

CPC .. G02F 1/13306; G02F 1/1333; G02F 1/1362; G02F 1/133; G09G 3/3607; G09G 2310/0232; G09G 2310/0233

See application file for complete search history.

(56) References Cited

U.S. PATENT DOCUMENTS

| | | | | |
|---|---|---|---|---|
| 8,217,968 | B2 * | 7/2012 | Sano | G09G 3/3413 345/102 |
| 2009/0102769 | A1 * | 4/2009 | Kouno | G09G 3/3648 345/88 |
| 2010/0156950 | A1 * | 6/2010 | Pak | G02B 5/201 345/690 |

(Continued)

FOREIGN PATENT DOCUMENTS

| | | |
|---|---|---|
| KR | 1020110066333 | 6/2011 |
| KR | 1020110130177 | 12/2011 |

(Continued)

*Primary Examiner* — Yuzhen Shen
(74) *Attorney, Agent, or Firm* — Cantor Colburn LLP

(57) ABSTRACT

A display device includes a display unit including a plurality of pixels, each of the pixels including a plurality of subpixels, and a display area having a corner of a non-right angular shape, and a signal controller controlling the display unit to display an image based on an input image signal and a control signal and changing a gray value of the image signal based on different light transmittance values of subpixels included in a first pixel, among the plurality of pixels, positioned at the corner of the non-right angular shape if the image signal corresponds to the first pixel at the corner of the non-right angular shape.

12 Claims, 5 Drawing Sheets

(56) References Cited

U.S. PATENT DOCUMENTS

| | | | | |
|---|---|---|---|---|
| 2014/0285511 | A1* | 9/2014 | Hoshino | G09G 5/10 345/590 |
| 2017/0125448 | A1* | 5/2017 | Park | H01L 51/5284 |
| 2018/0308413 | A1* | 10/2018 | Jin | G09G 3/3607 |

FOREIGN PATENT DOCUMENTS

| | | |
|---|---|---|
| KR | 1020130051312 | 5/2013 |
| KR | 1020150025774 | 3/2015 |
| KR | 1020150041459 | 4/2015 |

* cited by examiner

DISPLAY DEVICE ADJUSTING LUMINANCE OF PIXEL AT BOUNDARY AND DRIVING METHOD THEREOF

This application claims priority to Korean Patent Application No. 10-2016-0149860, filed on Nov. 10, 2016, and all the benefits accruing therefrom under 35 U.S.C. §119, the contents of which in its entirety is herein incorporated by reference.

BACKGROUND

(a) Field

Exemplary embodiments of the invention relate to a display device and a driving method thereof.

(b) Description of the Related Art

Demand for a display device having a display area with a non-right angular corner has increased. The display device having the corner of the non-right angular shape may be used for a display unit of a wearable device (e.g., a corner-type terminal such as a smartwatch), a glass-type terminal (e.g., a smart glass), a head mounted display ("HMD"), and a mobile cluster.

An overall shape of the display area is quadrangular. However, the corner of the display area has a rounded shape or a shape of which adjacent edges are connected so that an inner angle of adjacent edges exceeds 90 degrees.

SUMMARY

Because light transmittance of the pixels positioned at the corner of the non-right angular shape is reduced in part due to a light blocking member, there is a problem of causing a color shift. For example, when only a red subpixel is covered by the light blocking member, a green or blue stripe may be recognized in the corner of the non-right angular shape.

Exemplary embodiments provide a display device and a driving method thereof preventing the color shift from being generated at the corner of the non-right angular shape of a display area.

Also, exemplary embodiments provide a display device and a driving method thereof preventing images displayed at the corner of the non-right angular shape of the display area from being recognized as a step shape.

A display device according to an exemplary embodiment includes a display unit which includes a plurality of pixels and a display area having a corner of a non-right angular shape, where each of the pixels includes a plurality of subpixels and a signal controller which controls the display unit to display an image based on an input image signal and a control signal, and changes a gray value of the image signal based on different light transmittance values of subpixels included in a first pixel, among the plurality of pixels, positioned at the corner of the non-right angular shape if the image signal corresponds to the first pixel at the corner of the non-right angular shape.

In an exemplary embodiment, the display unit may further include a substrate including a corner of a non-right angular shape and a light blocking member positioned at a boundary of the display area and which overlaps at least one subpixel among the subpixels included in the first pixel positioned at the corner of the non-right angular shape of the display area.

In an exemplary embodiment, the signal controller may include a memory which stores light transmittance data of the subpixels included in the first pixel positioned at the corner of the non-right angular shape and included in a second pixel positioned near the corner of the display area and a correction coefficient calculation unit which reads the light transmittance values of the subpixels included in the first pixel from the memory to calculate at least one correction coefficient to correct the image signal corresponding to the subpixels included in the first or second pixel based on the control signal if the image signal corresponds to the first pixel or the second pixel.

In an exemplary embodiment, the signal controller may further include a luminance conversion unit which converts luminance data of the image signal according to a first gamma, a luminance correction unit which corrects the converted luminance data according to the at least one correction coefficient and a gray conversion unit which converts the corrected luminance data into gray data according to a first reverse gamma.

In an exemplary embodiment, the at least one correction coefficient may include first correction coefficients which compensates differences among the light transmittance values of the subpixels of the first pixel.

In an exemplary embodiment, the first correction coefficients may decrease gray values corresponding to the subpixels other than a subpixel having a lowest light transmittance among the subpixels of the first pixel.

In an exemplary embodiment, if the image signal corresponds to the second pixel, the correction coefficient calculation unit may calculate a second correction coefficient to correct the image signal based on a lowest value among the first correction coefficients.

In an exemplary embodiment, the second correction coefficient may have a value to decrease gray values of the subpixels included in the second pixel.

In an exemplary embodiment, if the image signal corresponds to the second pixel, the correction coefficient calculation unit may calculate third correction coefficients corresponding to the subpixels included in the second pixel based on the first correction coefficients.

According to an exemplary embodiment, a driving method of a display device to display an image on a display unit which includes a plurality of pixels and a display area having a corner of a non-right angular shape, wherein each of the pixels includes a plurality of subpixels includes receiving an image signal and a control signal, determining whether the image signal corresponds to a first pixel at the corner of the non-right angular shape, and changing a gray value of the image signal based on different light transmittance values of subpixels included in the first pixel positioned at the corner of the non-right angular shape if the image signal corresponds to the first pixel at the corner of the non-right angular shape.

In an exemplary embodiment, determining whether the image signal corresponds to the first pixel at the corner of the non-right angular shape may include determining whether the image signal corresponds to the first pixel positioned at the corner of the non-right angular shape or a second pixel positioned near the corner based on the control signal.

In an exemplary embodiment, changing the gray value of the image signal may include reading the light transmittance values of the subpixels included in the first pixel from a memory storing light transmittance data of the subpixels included in the first and second pixels and calculating at least one correction coefficient to correct the image signal.

In an exemplary embodiment, changing the gray value of the image signal may further include converting the image signal into the luminance data of the image signal according to a first gamma, correcting the converted luminance data according to the at least one correction coefficient, and converting the corrected luminance data into the gray data according to a first reverse gamma.

In an exemplary embodiment, the at least one correction coefficient may include first correction coefficients which compensates differences among the light transmittance values of the subpixels of the first pixel.

In an exemplary embodiment, the first correction coefficients may decrease gray values corresponding to the subpixels other than a subpixel of which the light transmittance is lowest among the subpixels of the first pixel.

In an exemplary embodiment, calculating the at least one correction coefficient may further include calculating a second correction coefficient to correct the image signal based on a lowest value among the first correction coefficients if the image signal corresponds to the second pixel.

In an exemplary embodiment, the second correction coefficient may have a value to decrease all the gray values of the subpixels included in the second pixel.

In an exemplary embodiment, calculating the at least one correction coefficient may include calculating third correction coefficients corresponding to the subpixels included in the second pixel based on the first correction coefficients if the image signal corresponds to the second pixel.

According to exemplary embodiments, there is an effect of preventing the color shift from being generated at the corner of the display area.

Also, according to exemplary embodiments, there is an effect of preventing the corner of the display area from being recognized in the step shape.

DETAILED DESCRIPTION

The invention will be described more fully hereinafter with reference to the accompanying drawings, in which exemplary embodiments are shown. As those skilled in the art would realize, the described exemplary embodiments may be modified in various different ways, all without departing from the spirit or scope of the invention.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/ or." As used herein, the term "and/or" includes any and all combinations of one or more of the associated listed items.

In addition, unless explicitly described to the contrary, the word "comprise" and variations such as "comprises" or "comprising" will be understood to imply the inclusion of stated elements but not the exclusion of any other elements.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 1:
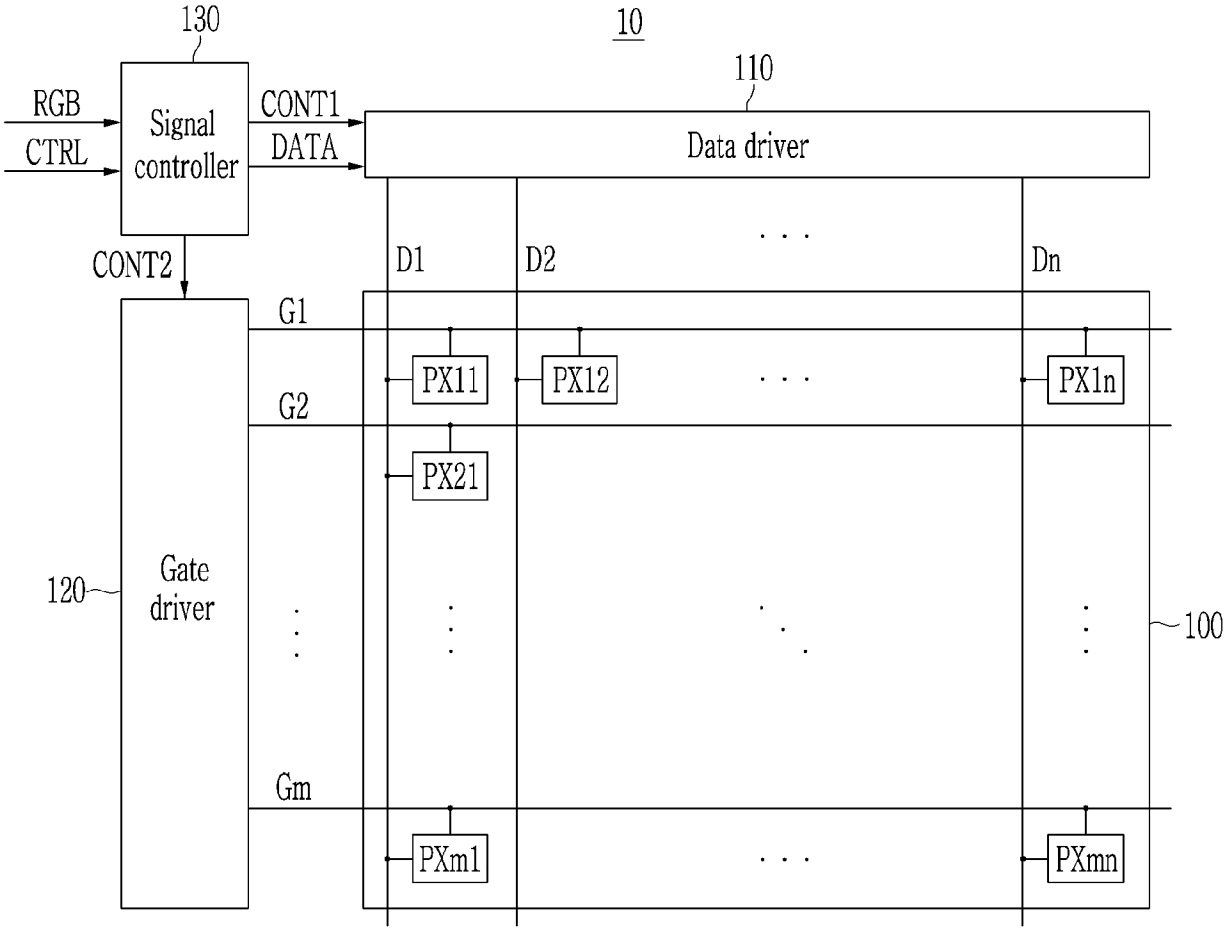
FIG. 1 is a block diagram schematically showing an exemplary embodiment of a display device according to the invention.

FIG. 1 is a block diagram schematically showing an exemplary embodiment of a display device according to the invention.

As shown in FIG. 1, a display device 10 includes a display unit 100, a data driver 110, a gate driver 120, and a signal controller 130.

The display unit 100 includes a plurality of display signal lines and a plurality of pixels PX11 to PXmn connected thereto. The display signal lines includes a plurality of gate lines G1 to Gm transmitting a gate signal (referred to as "a scanning signal") and a plurality of data lines D1 to Dn transmitting a data signal. The plurality of pixels PX11 to PXmn may be respectively connected to the corresponding gate lines G1 to Gm and data lines D1 to Dn. The plurality of pixels PX11 to PXmn may include a liquid crystal element or an organic light emitting diode. Hereinafter, it is assumed that the display device 10 is a liquid crystal display device in which the plurality of pixels PX11 to PXmn includes the liquid crystal element, and transmittance of the liquid crystal element is controlled depending on the data signal applied to each pixel.

The data driver 110 may divide a gray reference voltage received from a gray voltage generator (not shown) to generate gray voltages for all gray levels or receive a plurality of gray voltages from the gray voltage generator. The data driver 110 is connected to the data lines D1 to Dn of the display unit 100, and applies a plurality of data voltages to the data lines D1 to Dn.

The data driver 110 may receive image data DATA for pixels of one row depending on a data control signal CONT1 and converts the image data DATA into data voltages by selecting gray voltages corresponding to the image data DATA from the gray voltages for all gray levels, and then applies the data voltages to the corresponding data lines D1 to Dn.

The gate driver 120 is connected to the gate lines G1 to Gm to apply a gate signal made of a combination of a gate-on voltage and a gate-off voltage to the gate lines G1 to Gm.

The gate driver 120 applies the gate-on voltage to the gate lines G1 to Gm depending on a gate control signal CONT2 from the signal controller 130. Thus, the data voltage supplied to the data lines D1-Dn may be applied to the corresponding pixels.

Although not shown, a backlight unit may be positioned at a back side of the display unit 100 and may include at least one light source. As an example of the light source, a fluorescent lamp such as a cold cathode fluorescent lamp ("CCFL") or a light emitting diode ("LED") may be included.

The signal controller 130 controls operations of the gate driver 120 and the data driver 110, etc.

The signal controller 130 receives an image signal RGB and an input control signal CTRL that are input from the outside. The image signal RGB includes luminance information of each pixel of the display unit 100, and the luminance may be quantized into gray levels of a predetermined number such as 1024, 256, or 64. The input control signal CTRL may include a vertical synchronization signal, a horizontal synchronization signal, a main clock signal, and a data enable signal in relation to the image display.

The signal controller 130 may generate the image data DATA suitable for an operating condition of the display unit 100 based on the image signal RGB and the input control signal CTRL, and may generate a data control signal CONT1 and a gate control signal CONT2 based on the input control signal CTRL.

The signal controller 130 may correct the image signal RGB to output the image data DATA. In an exemplary embodiment, for example, the signal controller 130 may perform a correction for the image signal corresponding to the pixels positioned near corners of the display unit 100 among the image signal RGB.

The signal controller 130 may output the gate control signal CONT2 to the gate driver 120 and may output the data control signal CONT1 and the corrected image data DATA to the data driver 110.

The data control signal CONT1 may include a horizontal synchronization start signal, a clock signal, and a line latch signal, and the gate control signal CONT2 may include a scanning start signal, an output enable signal, and a gate pulse signal.

The gate driver 120 may apply the gate-on voltage to all gate lines G1 to Gm sequentially at an interval of 1 horizontal period (referred to as "1H" and being the same as one period of the horizontal synchronization signal and the data enable signal) based on the gate control signal CONT2, and the data driver 110 may apply the plurality of data voltages to all pixels PX11 to PXmn in synchronization with application timing of the gate-on voltage based on the data control signal CONT1.

Next, the display unit 100 of the display device 10 will be described in detail with reference to FIG. 2.

Figure 2:
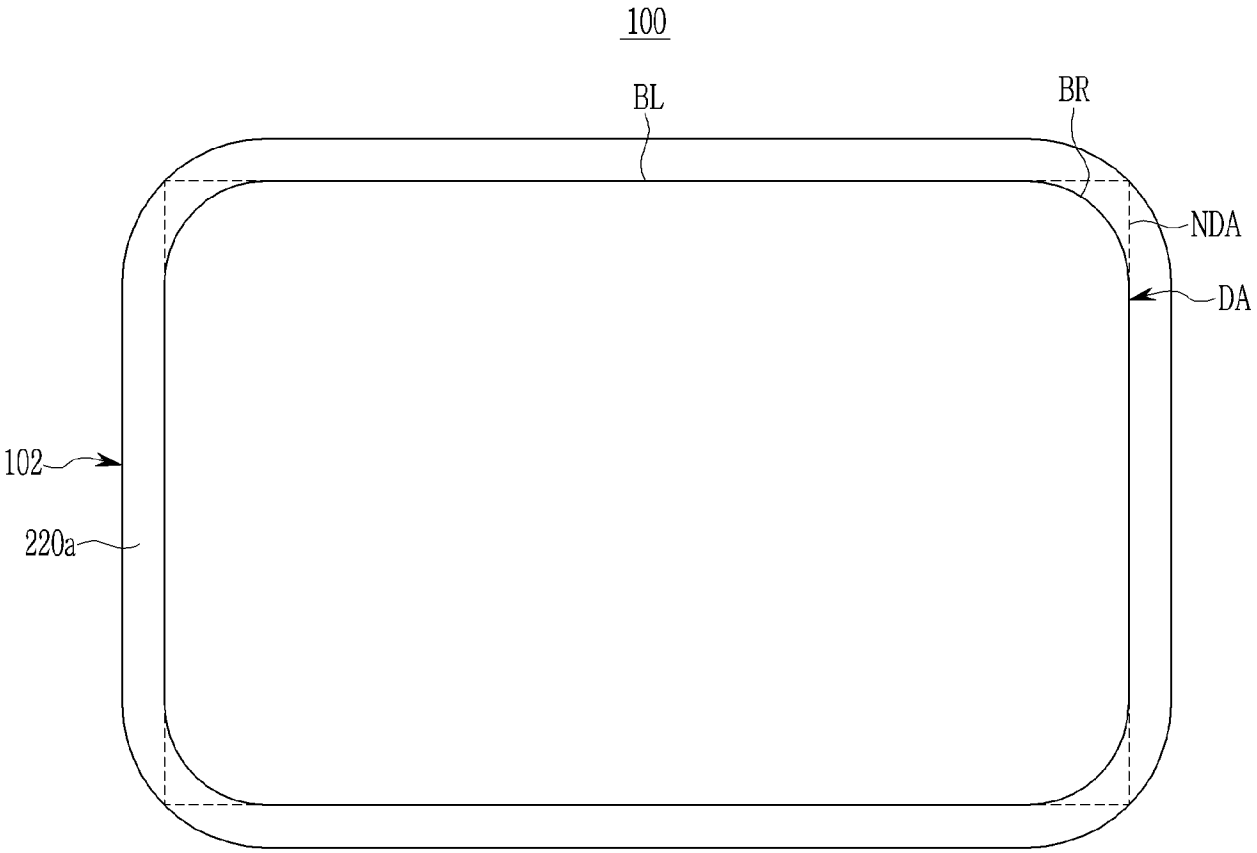
FIG. 2 is a top plan view schematically showing an exemplary embodiment of a display unit of a display device according to the invention.

FIG. 2 is a top plan view schematically showing an exemplary embodiment of a display unit of a display device according to the invention. As shown in FIG. 2, the display unit 100 includes a display area DA having an overall quadrangle shape with at least one non-right angular corner (e.g., a rounded corner). The display area DA includes an edge BL having a straight line shape and at least one corner BR having a non-right angular shape. Here, the corner means a portion of the display area DA, where two non-parallel and straight line edges meet. In an exemplary embodiment, for example, the corner of the non-right angular shape may have a rounded shape, or may have a shape including connected corners so that the interior angles of the connected corners exceed 90 degrees. Hereinafter, it is assumed that the corner of the non-right angular shape has the rounded shape.

The display unit 100 may include a first substrate 102 on which the plurality of pixels is positioned, and a light blocking member 220*a* positioned at the edge and corners of the first substrate 102. The first substrate 102 may have a shape corresponding to the shape of the display area DA. In an exemplary embodiment, for example, the first substrate 102 has the edge shape of four straight lines, and has the corner shape of a rounded type.

The light blocking member 220*a* may also be positioned to overlap a region NDA, in a plain view, on which the pixels emitting the light according to the data signal are positioned so that the display area DA has the corner of the rounded shape. The light blocking member 220*a* is made of a light blocking material, thereby preventing light leakage from being generated.

In FIG. 2, it is described that the light blocking member 220*a* is positioned on the plurality of pixels to implement the corner of the rounded shape. However, in an alternative embodiment, the corner of the rounded shape of the display area DA may be implemented by controlling the pixel number, the size of each pixel, the shape of each pixel, etc. along with the corner.

Also, the display unit 100 may be a display panel having flexibility. Further, the display unit 100 may be a curved display panel of which a part is formed with a shape of a curved surface.

Next, the pixels positioned at the corner of the rounded shape and other pixels adjacent thereto of the display device 10 according to an exemplary embodiment will be described with reference to FIG. 3.

Figure 3:
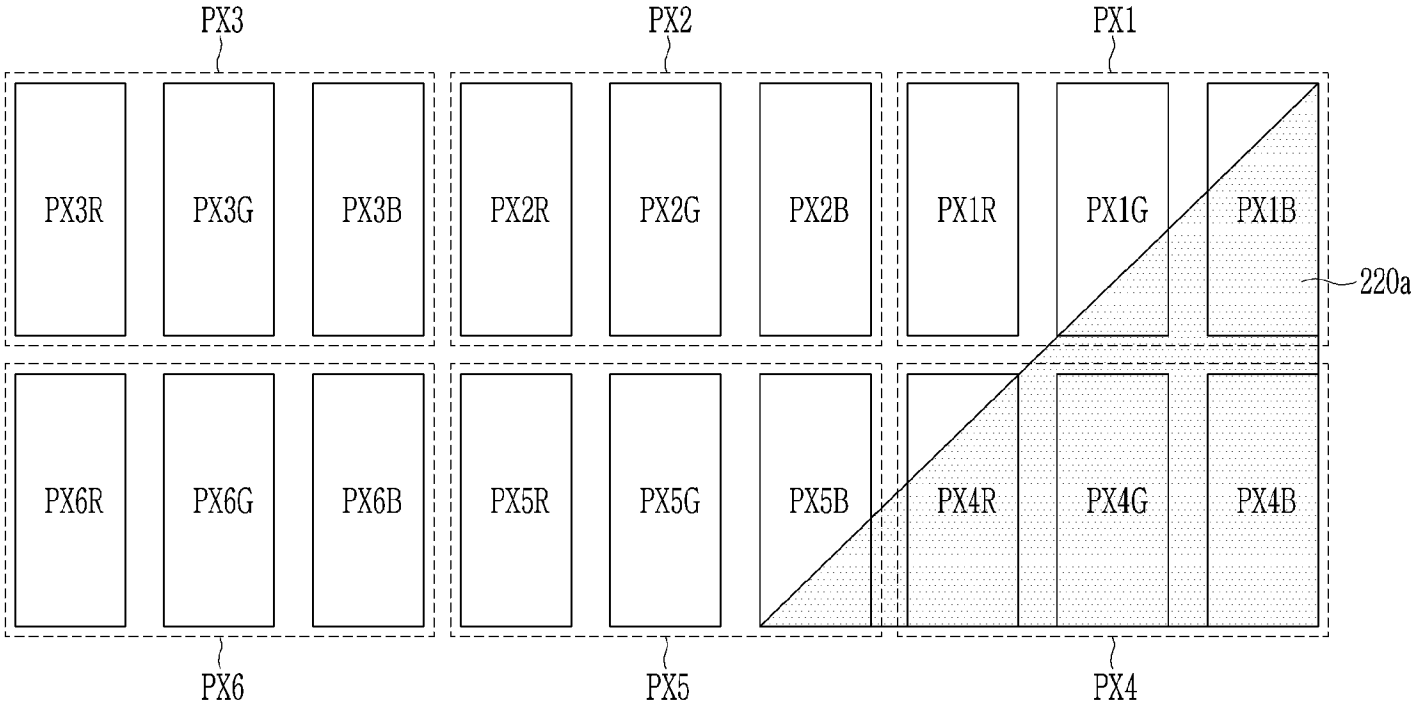
FIG. 3 is a top plan view showing an exemplary embodiment of a pixel of a display device according to the invention.

FIG. 3 is a top plan view showing an exemplary embodiment of a pixel of a display device according to the invention. As shown in FIG. 3, first to sixth pixels PX1 to PX6 may be positioned on the first substrate 102. Each of the first to sixth pixels PX1 to PX6 may include a plurality of subpixels corresponding to primary colors that are different from each other. In this case, sizes of each of the plurality of subpixels corresponding to the primary colors that are different from each other may be the same.

In an exemplary embodiment, for example, the first pixel PX1 includes three subpixels PX1R, PX1G, and PX1B, the second pixel PX2 includes three subpixels PX2R, PX2G, and PX2B, and the third pixel PX3 includes three subpixels PX3R, PX3G, and PX3B. The three subpixels represent red (R), green (G), and blue (B) colors, respectively. In the following description, for convenience of explanation, the R, G, and B color subpixels are named as a first, second, and third subpixels, respectively.

However, the arrangement shape of the subpixels is not limited thereto and may be variously changed. Also, in this embodiment, each pixel including a red subpixel, a green subpixel, and a blue subpixel is shown. However the present invention is not limited thereto.

It is assumed that the first pixel PX1, a fourth pixel PX4, and a fifth pixel PX5 are positioned at the corner of the display area DA. Thus, the light blocking member 220*a* may overlap at least one subpixel of each of the first pixel PX1, the fourth pixel PX4, and the fifth pixel PX5.

In the following description, for convenience of explanation, the first pixel PX1 among the pixels overlapping the light blocking member 220*a* is described. The light blocking member 220*a* may be positioned on the second subpixel PX1G and the third subpixel PX1B of the first pixel PX1 to overlap the subpixels, thereby implementing the corner of the rounded shape. In this case, the light transmittance of the second subpixel PX1G and the light transmittance of the third subpixel PX1B are reduced by the light blocking member 220*a*. In an exemplary embodiment, for example, the light transmittance of the second subpixel PX1G is reduced by 50% with respect to the light transmittance of the first subpixel PX1R, and the light transmittance of the third subpixel PX1B is reduced by 80% with respect to the light transmittance of the first subpixel PX1R which is not blocked by the light blocking member 220*a*.

Also, the second pixel PX2 adjacent to the first pixel PX1 in the row direction does not overlap the light blocking member 220*a*. The second pixel PX2 is located farther than the first pixel PX1 from the corner of the display area DA. Further, the third pixel PX3 adjacent to the second pixel PX2 in the row direction also does not overlap the light blocking member 220*a*, and the third pixel PX3 is located farther than the second pixel PX2 from the corner of the display area DA. Likewise, the sixth pixel PX6 adjacent to the fifth pixel PX5 in the row direction does not overlap the light blocking member 220*a*. The sixth pixel PX6 is located farther than the fifth pixel PX5 from the corner of the display area DA.

As the light transmittance of the second subpixel PX1G and the light transmittance of the third subpixel PX1B are reduced by the light blocking member 220*a*, intensity of the light emitted from the second subpixel PX1G and the third subpixel PX1B is reduced, thereby the color shift may occur at the corner of the rounded shape. Also, due to the reduced intensity of the light emitted from the second subpixel PX1G and the third subpixel PX1B, the corner of the rounded shape may be recognized as a step shape rather than the rounded shape.

A driving method of the signal controller 130 and the display device 10 correcting the image signal RGB for preventing the color shift from being occurred and the step shape from being recognized will be described with reference to FIG. 4 and FIG. 5.

Figure 4:
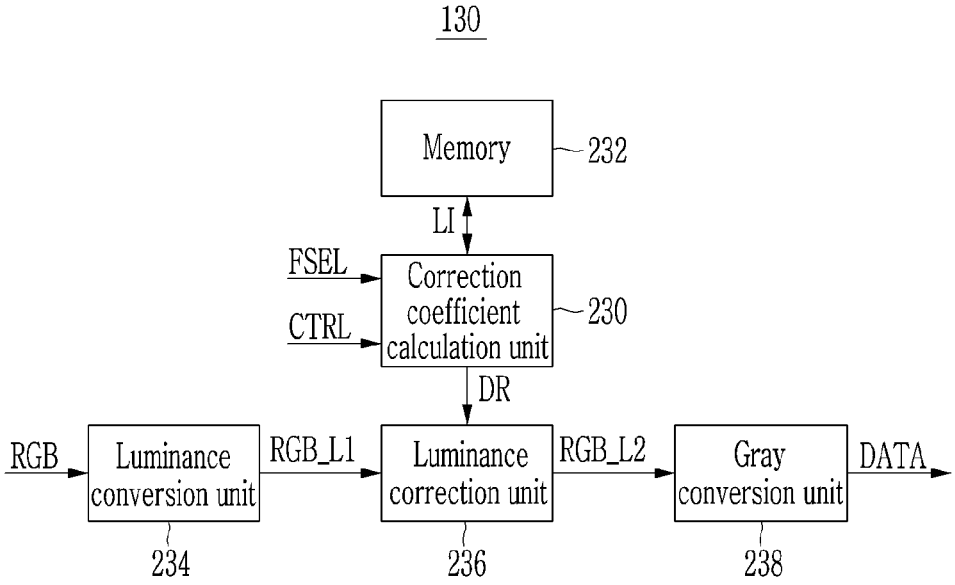
FIG. 4 is a block diagram showing an exemplary embodiment of a partial configuration of a signal controller of a display device according to the invention.

FIG. 4 is a block diagram showing an exemplary embodiment of a partial configuration of a signal controller of a display device according to the invention. As shown in FIG. 4, the signal controller 130 includes a correction coefficient calculation unit 230, a memory 232, a luminance conversion unit 234, a luminance correction unit 236, and a gray conversion unit 238.

The correction coefficient calculation unit 230 receives a control signal CTRL and a correction filter selection signal FSEL.

The correction filter selection signal FSEL is a signal to calculate a correction coefficient, and includes information related to the correction of the image signal RGB corresponding to the pixel (e.g., the first pixel PX1) positioned at the corner and the image signal RGB of the pixel (e.g., the second pixel PX2 and the third pixel PX3) positioned near the corner.

The correction coefficient calculation unit 230 determines a correction method to correct the image signal RGB. In this case, the correction method may be determined based on a region where the image signal RGB is displayed or a selection of a user. The correction method may include a color balance correction method, a luminance correction method, a color correction method, a color luminance correction method, or a non-correction method.

The correction coefficient calculation unit 230 may calculate the correction coefficient to correct the image signal RGB depending on the region in which the input image signal RGB is displayed in the display unit 100.

The correction coefficient calculation unit 230 may determine whether the currently input image signal RGB is displayed at the corner of the display area DA or near the corner of the display area DA based on the horizontal synchronization signal and the data enable signal included in the control signal CTRL.

The memory 232 stores light transmittance data of the subpixels included in each pixel positioned at the corner of the rounded shape. Thus, the correction coefficient calculation unit 230 reads the light transmittance data to correct the image signal RGB from the memory 232.

The correction coefficient calculation unit 230 may calculate the correction coefficient by using the region information where the input image signal RGB is displayed, the value of the correction filter selection signal FSEL, and the light transmittance data of the subpixels.

The correction coefficient calculation unit 230 may calculate the correction coefficient by a following method.

The correction coefficient calculation unit 230 calculates a color balance correction coefficient. In an exemplary embodiment, for example, when the input image signal RGB is that of the pixel (hereinafter, the first pixel PX1 is described) at the corner, the correction coefficient calculation unit 230 calculates the color balance correction coefficient of the first pixel PX1 based on the color balance filter value included in the correction filter selection signal FSEL and the light transmittance data of the first pixel PX1.

$$RDR1 = \frac{\mathrm{Min}(RT, GT, BT)}{RT} \times k \qquad \text{(Equation 1)}$$

In Equation 1, RDR1 is the color balance correction coefficient of the first subpixel PX1R of the first pixel PX1, k is a color balance filter value, RT is the light transmittance of the first subpixel PX1R of the first pixel PX1, GT is the light transmittance of the second subpixel PX1G of the first pixel PX1, and BT is the light transmittance of the third subpixel PX1B of the first pixel PX1.

The color balance filter value k may have a value of 1 when the color balance correction coefficient of the subpixel (e.g., the third subpixel PX1B of the first pixel PX1) of which the transmittance is lowest among the subpixels included in one pixel is calculated. The color balance filter value k may have a value of more than 1 when the color balance correction coefficient of the subpixel (e.g., the first or second subpixels PX1R or PX1G of the first pixel PX1) other than the subpixel of which the transmittance is lowest among the subpixels included in one pixel is calculated, and may have a value such that the color balance correction coefficient calculated by Equation 1 is not over 1.

As a similar method, the color balance correction coefficient GDR1 of the second subpixel PX1G of the first pixel PX1 and the color balance correction coefficient BDR1 of the third subpixel PX1B of the first pixel PX1 may be calculated.

Also, when the input image signal RGB corresponds to the second pixel PX2 or the third pixel PX3 which is near the first pixel PX1 in the row direction, the correction coefficient calculation unit 230 calculates the color balance correction coefficient of the first pixel PX1 by using the light transmittance data of the first pixel PX1.

The light transmittance of the third subpixel PX1B of the first pixel PX1 is lower than the light transmittance of the first subpixel PX1R and the second subpixel PX1G of the first pixel PX1. Therefore, red light emitted from the first subpixel PX1R and green light emitted from the second subpixel PX1G are more easily recognized than blue light emitted from the third subpixel PX1B. Accordingly, when the same gray data is applied to each of the subpixels PX1R, PX1G, and PX1B included in the first pixel PX1, a color shift phenomenon that the first pixel PX1 is recognized as a yellow color rather than a white color since red are green are mixed due to the light transmittance difference may be generated.

The color balance correction method is used to prevent the color shift phenomenon. According to the color balance correction method, a magnitude of the data applied to the first subpixel PX1R and the second subpixel PX1G may be reduced by a ratio calculated according to each light transmittance of the first subpixel PX1R, the second subpixel PX1G, and the third subpixel PX1B.

The correction coefficient calculation unit 230 may also calculate a luminance correction coefficient. The correction coefficient calculation unit 230 may calculate the luminance correction coefficient through Equation 2 and Equation 3 below by using a luminance rendering filter value included in the correction filter selection signal FSEL and the color balance correction coefficients of the first pixel PX1 to the third pixel PX3.

$$MDR1=\mathrm{Min}(RDR1,\ GDR1,\ BDR1) \qquad \text{(Equation 2)}$$

In Equation 2, MDR1 is a lowest color balance correction coefficient among the color balance correction coefficients of the subpixels of the corresponding pixel, and RDR1, GDR1, and BDR1 are the color balance correction coefficients of the subpixels of the corresponding pixel, respectively.

$$DR2(x-1,\ y) = MDR1(x-1,\ y)\times L1 + \times MRD1(x,\ y)\times L2 \qquad \text{(Equation 3)}$$

In Equation 3, (x,y) represents coordinates of the first pixel PX1, and (x−1,y) represents coordinates of the second pixel PX2 most adjacent to the first pixel PX1 in the row direction. Also, MDR1(x,y) is the lowest color balance correction coefficient among the color balance correction coefficients of the subpixels of the first pixel PX1, MDR1 (x−1,y) is the lowest color balance correction coefficient among the color balance correction coefficients of the subpixels of the second pixel PX2, and L1 and L2 are luminance rendering filter values. The luminance rendering filter values may be predetermined values (e.g., L1=¾, L2=¼) which substantially reduces the luminance of the pixel (e.g., PX2) adjacent to the corner. The second pixel PX2 is not the pixel positioned at the corner but just adjacent to the corner such that the value of the lowest color balance correction coefficient among the color balance correction coefficients of the subpixels of the second pixel PX2 may be 1. DR2(x−1,y) calculated by Equation 3 is the luminance correction coefficient of the second pixel PX2.

Likewise, the luminance correction coefficient of the third pixel PX3 may be calculated by using Equation 3. In an exemplary embodiment, for example, if (x,y) represents the coordinates of the second pixel PX2, (x−1,y) represents the coordinates of the third pixel PX3 most adjacent to the second pixel PX2 in the row direction, MDR1(x,y) is the lowest color balance correction coefficient among the color balance correction coefficients of the subpixels of the second pixel PX2, and MDR1(x−1,y) is the lowest color balance correction coefficient among the color balance correction coefficients of the subpixels of the third pixel PX3, DR2(x−1,y) calculated by Equation 3 may be the luminance correction coefficient of the third pixel PX3. The third pixel PX3 is not the pixel positioned at the corner such that the value of the lowest color balance correction coefficient among the color balance correction coefficients of the subpixels of the second pixel PX2 may be 1.

The luminance correction method is a method of correcting the luminance of the second pixel PX2 and the third pixel PX3 which are adjacent to the first pixel PX1 by using the color balance correction coefficients and the luminance rendering filter value of the first pixel PX1. The luminance correction coefficient may be calculated by the luminance correction method so as to decrease the luminance of the pixels adjacent to the corner. Accordingly, the luminance correction method may prevent the step shape recognition at the pixels of the corner that is caused by the overall reduction of the luminance of the first pixel PX1 due to application of the color balance correction method.

In the luminance correction method, if the input image signal RGB corresponds to the first pixel PX1, the correction coefficient calculation unit 230 outputs the color balance correction coefficients RDR1, GDR1, and BDR1 of the first to third subpixels PX1R, PX1G, and PX1B to the luminance correction unit 236. However, if the input image signal RGB corresponds to the second pixel PX2 or the third pixel PX3, the correction coefficient calculation unit 230 does not output the color balance correction coefficient to the luminance correction unit 236.

Also, the correction coefficient calculation unit 230 may calculate the color correction coefficient. The correction coefficient calculation unit 230 may calculate the color correction coefficient through Equation 4 below by using the color rendering filter value included in the correction filter selection signal FSEL and the color balance correction coefficients of the first pixel PX1 to the third pixel PX3.

$$RDR2(x-1,y)=RDR1(x-1,y)\times C1+RDR1(x,y)\times C2 \qquad \text{(Equation 4)}$$

In Equation 4, RDR1(x,y) is the color balance correction coefficient of the first subpixel PX1R of the first pixel PX1, RDR1(x−1,y) is the color balance correction coefficient of the first subpixel PX2R of the second pixel PX2, and C1 and C2 are the color rendering filter values. The color rendering filter values C1 and C2 may have such predetermined values (e.g., C1=¼ and C2=¾) that the luminance of some subpixels included in the pixel adjacent to the corner decreases and the luminance of the other subpixel increases. RDR2 (x−1,y) calculated by Equation 4 is the color correction coefficient of the first subpixel PX2R of the second pixel PX2.

Likewise, by using Equation 4, the color correction coefficient of the second subpixel PX2G of the second pixel PX2 and the color correction coefficient of the third subpixel PX2B of the second pixel PX2 may be calculated.

The color correction method is a method of correcting the luminance of the subpixels PX2R, PX2G, and PX2B of the second pixel PX2 adjacent to the first pixel PX1 by using the color balance correction coefficient and the color rendering filter value of the subpixels PX1R, PX1G, and PX1B of the first pixel PX1. The color correction coefficients may be calculated by the color correction method so as to increase the luminance of some subpixels among the subpixels of the pixel adjacent to the corner and to decrease the luminance of the other subpixel.

In an exemplary embodiment of the color balance correction method, for example, it is assumed that the color balance correction coefficient of the first subpixel PX1R of the first pixel PX1 is calculated by applying various color balance filter values. The color balance correction coefficient calculated by applying the color balance filter value having the value of more than 1 (hereinafter, "the first value") to Equation 1 is larger than the color balance correction coefficient calculated by applying the color balance filter value having the value of 1 (hereinafter, "the second value") to Equation 1.

First gray data, which is uncorrected gray data of the first subpixel PX1R of the first pixel PX1, may be corrected by the color balance correction coefficient calculated by using the first value or the color balance correction coefficient calculated by using the second value. The gray data (hereinafter, "the second gray data") that is corrected according to the first value may have the larger value than the gray data (hereinafter, "the third gray data") that is corrected according to the second value.

The intensity of the light emitted from the first subpixel PX1R by applying the third gray data may be substantially the same as the intensity of the light emitted from the third subpixel PX1B having the lowest light transmittance among the subpixels of the first pixel PX1 by applying the first gray data. Accordingly, the intensity of the light emitted from the first subpixel PX1R by applying the second gray data may be higher than the intensity of the light emitted from the third subpixel PX1B by applying the first gray data.

Therefore, if the color balance correction coefficient which applies the color balance filter value having the value of more than 1 is used, the color shift by the light emitted from the first subpixel PX1R may be recognized.

According to the color correction method, the color correction coefficients of the subpixels PX2R and PX2G of the second pixel PX2 may be calculated so as to decrease the light emitted from the subpixels PX2R and PX2G of the second pixel PX2 corresponding to the subpixels PX1R and PX1G having the relatively small value of the color balance correction coefficient among the subpixels PX1R, PX1G, and PX1B included in the first pixel PX1.

Also, the color correction coefficient of the subpixel PX2B of the second pixel PX2 may be calculated so as to increase the light emitted from the subpixel PX2B of the second pixel PX2 corresponding to the subpixel PX1B having the relatively high value of the color balance correction coefficient among the subpixels PX1R, PX1G, and PX1B included in the first pixel PX1. Accordingly, by considering each color balance correction coefficient of the subpixels PX1R, PX1G, and PX1B included in the first pixel PX1 calculated by the color balance correction method, the color correction method controls the light emitted from the subpixels PX2R, PX2G, and PX2B included in the second pixel PX2, thereby preventing the color shift phenomenon by the first pixel PX1.

Finally, the correction coefficient calculation unit 230 may calculate the color luminance correction coefficient. The color luminance correction coefficient may be calculated by a method as follows. In an exemplary embodiment, for example, the correction coefficient calculation unit 230 may calculate the luminance correction coefficient of the second pixel PX2 and the third pixel PX3 according to the luminance correction method and each color correction coefficient of the subpixels of the second pixel PX2 according to the color correction method. Then, the correction coefficient calculation unit 230 may calculate the color luminance correction coefficient by adjusting the luminance correction coefficient of the second pixel PX2 calculated according to the luminance correction method by the color correction coefficient of each subpixel of the second pixel PX2 calculated according to the color correction method.

To help understanding, the color balance correction coefficient, the luminance correction coefficient, and the color luminance correction coefficient calculated by the correction coefficient calculation unit 230 are shown in Table 1 below.

TABLE 1

| | PX3R | PX3G | PX3B | PX2R | PX2G | PX2B | PX1R | PX1G | PX1B |
|---|---|---|---|---|---|---|---|---|---|
| Transmittance | 1 | 1 | 1 | 1 | 1 | 1 | 1 | 0.5 | 0.2 |
| Color balance correction coefficient | 1 | 1 | 1 | 1 | 1 | 1 | 0.4 | 0.6 | 1 |
| Luminance correction coefficient | 0.9625 | 0.9625 | 0.9625 | 0.85 | 0.85 | 0.85 | 0.4 | 0.6 | 1 |
| Color luminance correction coefficient | 0.9625 | 0.9625 | 0.9625 | 0.2425 | 0.2575 | 0.9625 | 0.4 | 0.6 | 1 |

Referring to Table 1, by the color balance correction coefficients, the value of the data applied to the first subpixel PX1R and the second subpixel PX1G included in the first pixel PX1 decreases. The value of the data applied to the third pixel PX3 and the second pixel PX2 decreases by the luminance correction coefficient. Also, by the color luminance correction coefficient, the value of the data applied to the first subpixel PX2R and the second subpixel PX2G of the second pixel PX2 decreases, and the value of the data applied to the third subpixel PX2B of the second pixel PX2 increases in comparison to the value of the data applied to the third pixel PX3 and the second pixel PX2 using the luminance correction coefficient.

The correction coefficient calculation unit 230 outputs the correction coefficient data DR according to the determined correction method to the luminance correction unit 236. In an exemplary embodiment, for example, when the color balance correction method is determined as the correction method, the correction coefficient calculation unit 230 outputs the correction coefficient data DR corresponding to the color balance correction coefficients to the luminance correction unit 236. Likewise, when the color luminance correction method is determined as the correction method, the correction coefficient calculation unit 230 outputs the correction coefficient data DR corresponding to the color luminance correction coefficients to the luminance correction unit 236. On the other hand, when the non-correction method is determined as the correction method, the correction coefficient calculation unit 230 may not output the correction coefficient data DR to the luminance correction unit 236 or may output the correction coefficient data DR of which all correction coefficients are 1 to the luminance correction unit 236. The luminance conversion unit 234 may convert the input image signal RGB into a converted image signal RGB_L1 according to the corresponding gamma. In an exemplary embodiment, for example, the luminance conversion unit 234 may convert the input image signal RGB into the converted image signal RGB_L1 by applying a 2.2 gamma to the gray data included in the image signal RGB. In other exemplary embodiments, the gamma may be a randomly selected gamma, or may include a 1.8 gamma, a 2.0 gamma, the 2.2 gamma, etc. However, the invention is not limited thereto.

The luminance correction unit 236 may output corrected image signal RGB_L2 calculated by multiplying the correction coefficient data DR by the converted image signal RGB_L1. In an exemplary embodiment, for example, it is assumed that the converted image signal RGB_L1 corresponding to the first to third subpixels PX2R, PX2G, and PX2B of the second pixel PX2 converted by the 2.2 gamma all has a value of 100 in gray data of each subpixel. The luminance correction unit 236 multiplies the color luminance correction coefficient data 0.2425, 0.2575, and 0.9625 by the gray data of the image signal RGB_L1 corresponding to the subpixels, respectively when the color luminance correction method is used as the correction method. Thus the calculated gray values of the corrected image signal RGB_L2 corresponding to the first to third subpixels PX2R, PX2G, and PX2B of the second pixel PX2 are 24.25, 25.75, and 96.25, respectively.

The gray conversion unit 238 may convert the input corrected image signal RGB_L2 into the image data DATA according to the corresponding reverse gamma. That is, the gray conversion unit 238 may output the image data DATA by applying the reverse gamma to the corrected image signal RGB_L2. In this case, the reverse gamma may have an inverse-function relationship with the gamma used in the luminance conversion unit 234.

Hereinafter, a driving method of the display device 10 according to the exemplary embodiment will be described with reference to FIG. 5.

Figure 5:
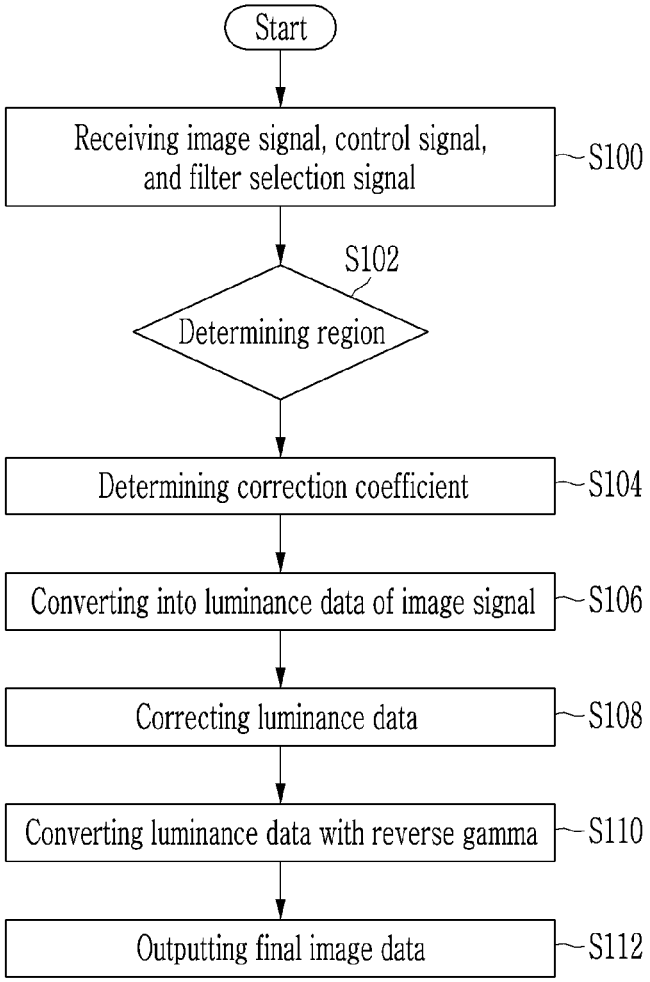
FIG. 5 is a flowchart showing an exemplary embodiment of an operation of the signal controller of FIG. 4.

FIG. 5 is a flowchart showing an exemplary embodiment of an operation of the signal controller 130 of FIG. 4. The signal controller 130 may receive the image signal RGB, the control signal, CTRL and the filter selection signal FSEL (S100).

The correction coefficient calculation unit 230 of the signal controller 130 determines the region where the input image signal RGB is displayed in the display unit 100 based on the control signal CTRL (S102).

The correction coefficient calculation unit 230 determines the correction coefficient to correct the image signal RGB according to the region where the image signal RGB is displayed in the display unit 100 (S104). In an exemplary embodiment, for example, if the image signal RGB is displayed in the region that is not adjacent to the corner of the rounded shape, the correction coefficient calculation unit 230 outputs the correction coefficient according to the non-correction method. Also, if the image signal RGB is displayed in the corner of the rounded shape of the display unit 100 or the region adjacent to the corner of the rounded shape, the correction coefficient calculation unit 230 outputs the correction coefficient calculated by at least one method among the color balance correction method, the luminance correction method, the color correction method, and the color luminance correction method. In this case, the correction method may also be determined by a selection of the user.

The luminance conversion unit 234 may convert luminance data of the input image signal RGB into luminance data of the converted image signal RGB_L1 according to the corresponding gamma (S106). The luminance correction unit 236 may correct the luminance data of the converted image signal RGB_L1 by using the correction coefficient (S108).

The gray conversion unit 238 may convert luminance data of the corrected image signal RGB_L2 into the gray data of the image data DATA according to the corresponding reverse gamma (S110) and outputs the image data DATA to the data driver 110. Here, luminance data of an image signal is a gray data of the image signal.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A display device comprising:

a display unit which includes a plurality of pixels and a display area having a boundary including a corner of a non-right angular shape, wherein each of the pixels includes a plurality of subpixels; and a signal controller which controls the display unit to display an image through the display area based on an input image signal and a control signal, and changes a gray value of the image signal based on different light transmittance values of subpixels included in a first pixel, among the plurality of pixels, positioned at the corner of the non-right angular shape if the image signal corresponds to the first pixel at the corner of the non-right angular shape, wherein the corner of the non-right angular shape overlaps a portion of the first pixel in a plan view, wherein the display unit further includes:

a substrate including a corner of a non-right angular shape; and a light blocking member positioned at the boundary of the display area and which overlaps at least one subpixel among the subpixels included in the first pixel positioned at the corner of the non-right angular shape of the display area, wherein the light transmittance values of the subpixels are different from each other according to a size of an area where the light blocking member and each subpixel overlaps, and the gray value of the image signal to be changed includes gray values of all subpixels included in the first pixel to be changed, and the gray value of each subpixel of the first pixel is calculated based on the light transmittance values of all subpixels included in the first pixel, wherein the signal controller includes:

a memory which stores light transmittance data of the subpixels included in the first pixel positioned at the corner of the non-right angular shape and included in a second pixel positioned near the corner of the display area; and a correction coefficient calculator which reads the light transmittance values of the subpixels included in the first pixel from the memory to calculate at least one correction coefficient to correct the image signal corresponding to the subpixels included in the first or second pixel based on the control signal if the image signal corresponds to the first pixel or the second pixel, wherein the at least one correction coefficient includes first correction coefficients which compensate differences among the light transmittance values of the subpixels of the first pixel, and wherein if the image signal corresponds to the second pixel, the correction coefficient calculation unit calculates a second correction coefficient to correct the image signal based on a lowest value among the first correction coefficients.

2. The display device of claim 1, wherein the display unit further includes:

a substrate including a corner of a non-right angular shape; and a light blocking member positioned at the boundary of the display area and which overlaps at least one subpixel among the subpixels included in the first pixel positioned at the corner of the non-right angular shape of the display area.

3. The display device of claim 1, wherein the signal controller further includes:

a luminance converter which converts luminance data of the image signal according to a first gamma;

a luminance corrector which corrects the converted luminance data according to the at least one correction coefficient; and a gray converter which converts the corrected luminance data into gray data according to a first reverse gamma.

4. The display device of claim 1, wherein the first correction coefficients decrease gray values corresponding to the subpixels other than a subpixel having a lowest light transmittance among the subpixels of the first pixel.

5. The display device of claim 1, wherein the second correction coefficient has a value to decrease gray values of the subpixels included in the second pixel.

6. A display device comprising:

a display unit which includes a plurality of pixels and a display area having a boundary including a corner of a non-right angular shape, wherein each of the pixels includes a plurality of subpixels; and a signal controller which controls the display unit to display an image through the display area based on an input image signal and a control signal, and changes a gray value of the image signal based on different light transmittance values of subpixels included in a first pixel, among the plurality of pixels, positioned at the corner of the non-right shape if the image signal corresponds to the first pixel at the corner of the non-right angular shape, wherein the corner of the non-right angular shape overlaps a portion of the first pixel in a plan view, wherein the display unit further includes:

a substrate including a corner of a non-right angular shape; and a light blocking member positioned at the boundary of the display area and which overlaps at least one subpixel among the subpixels included in the first pixel positioned at the corner of the non-right angular shape of the display area, wherein the light transmittance values of the subpixels are different from each other according to a size of an area where the light blocking member and each subpixel overlaps, and the gray value of the image signal to be changed includes gray values of all subpixels included in the first pixel to be changed, and the gray value of each subpixel of the first pixel is calculated based on the light transmittance values of all subpixels included in the first pixel, wherein the signal controller includes:

a memory which stores light transmittance data of the subpixels included in the first pixel positioned at the corner of the non-right angular shape and included in a second pixel positioned near the corner of the display area; and a correction coefficient calculator which reads the light transmittance values of the subpixels included in the first pixel from the memory to calculate at least one correction coefficient to correct the image signal corresponding to the subpixels included in the first or second pixel based on the control signal if the image signal corresponds to the first pixel or the second pixel, wherein the at least one correction coefficient includes first correction coefficients which compensate differences among the light transmittance values of the subpixels of the first pixel, and wherein if the image signal corresponds to the second pixel, the correction coefficient calculation unit calculates third correction coefficients corresponding to the subpixels included in the second pixel based on the first correction coefficients.

7. A driving method of a display device to display an image on a display unit which includes a plurality of pixels and a display area having a boundary including a corner of a non-right angular shape, wherein each of the pixels includes a plurality of subpixels, comprising:

receiving an image signal and a control signal;

determining whether the image signal corresponds to a first pixel at the corner of the non-right angular shape; and changing a gray value of the image signal based on different light transmittance values of subpixels included in the first pixel positioned at the corner of the non-right angular shape if the image signal corresponds to the first pixel at the corner of the non-right angular shape, wherein the corner of the non-right angular shape overlaps a portion of the first pixel in a plan view, wherein the display unit further includes:

a substrate including a corner of a non-right angular shape; and a light blocking member positioned at the boundary of the display area and which overlaps at least one subpixel among the subpixels included in the first pixel positioned at the corner of the non-right angular shape of the display area, wherein the light transmittance values of the subpixels are different from each other according to a size of an area where the light blocking member and each subpixel overlaps, and the gray value of the image signal to be changed includes gray values of all subpixels included in the first pixel to be changed, and the gray value of each subpixel of the first pixel is calculated based on the light transmittance values of all subpixels included in the first pixel, wherein changing the gray value of the image signal includes reading the light transmittance values of the subpixels included in the first pixel from a memory storing light transmittance data of the subpixels included in the first and second pixels and calculating at least one correction coefficient to correct the image signal, wherein the at least one correction coefficient includes first correction coefficients which compensates differences among the light transmittance values of the subpixels of the first pixel, and wherein calculating the at least one correction coefficient further includes calculating a second correction coefficient to correct the image signal based on a lowest value among the first connection coefficients if the image signal corresponds to the second pixel.

8. The driving method of claim 7, wherein determining whether the image signal corresponds to the first pixel at the corner of the non-right angular shape includes determining whether the image signal corresponds to the first pixel positioned at the corner of the non-right angular shape or a second pixel positioned near the corner based on the control signal.

9. The driving method of claim 7, wherein changing the gray value of the image signal further includes converting the image signal into the luminance data of the image signal according to a first gamma, correcting the converted luminance data according to the at least one correction coefficient, and converting the corrected luminance data into the gray data according to a first reverse gamma.

10. The driving method of claim 7, wherein the first correction coefficients decrease gray values corresponding to the subpixels other than a subpixel of which the light transmittance is lowest among the subpixels of the first pixel.

11. The driving method of claim 7, wherein the second correction coefficient has a value to decrease all the gray values of the subpixels included in the second pixel.

12. A driving method of a display device to display an image on a display until which includes a plurality of pixels and a display area having a boundary including a corner of a non-right angular shape, wherein each of the pixels includes a plurality of subpixels, comprising;

receiving an image signal and a control signal;

determining whether the image signal corresponds to a first pixel at the corner of the non-right angular shape; and changing a gray value of the image signal based on different light transmittance values of subpixels included in the first pixel positioned at the corner of the non-right angular shape if the image signal corresponds to the first pixel at the corner of the non-right angular shape;

wherein the corner of the non-right angular shape overlaps a portion of the first pixel in a plan view, wherein the display unit further includes:

a substrate including a corner of a non-right angular shape; and a light blocking member positioned at the boundary of the display area and which overlaps at least one subpixel among the subpixels included in the first pixel positioned at the corner of the non-right angular shape of the display area, wherein the light transmittance values of the subpixels are different from each other according to a size of an area where the light blocking member and each subpixel overlaps, and the gray value of the image signal to be changed includes gray values of all subpixels included in the first pixel to be changed, and the gray value of each subpixel of the first pixel is calculated based on the light transmittance value of all subpixels included in the first pixel, wherein changing the gray value of the image signal includes reading the light transmittance values of the subpixels included in the first and second pixels and calculating at least one correction coefficient to correct the image signal, wherein the at least one correction coefficient includes first correction coefficients which compensates differences among the light transmittance values of the subpixels of the first pixel, and wherein calculating the at least one correction coefficient includes calculating third correction coefficients corresponding to the subpixels included in the second pixel based on the first correction coefficients if the image signal corresponds to the second pixel.

* * * * *